US005772148A

United States Patent [19]

Vollenweider

[11] Patent Number: 5,772,148

[45] Date of Patent: Jun. 30, 1998

[54] METHOD AND DEVICE FOR WINDING PRINTED PRODUCTS IN SCALED FORMATION

[75] Inventor: Jürg Vollenweider, Fehraltorf, Switzerland

[73] Assignee: Ferag AG, Hinwil, Switzerland

[21] Appl. No.: 800,757

[22] Filed: Feb. 14, 1997

[30] Foreign Application Priority Data

Feb. 16, 1996 [CH] Switzerland ..... 40414/96

[51] Int. Cl.[6] ..... B65H 18/22; B65H 16/02; B65H 23/08

[52] U.S. Cl. ..... 242/423.1; 242/528; 242/541.3; 242/564.5; 242/595.1; 242/597.7

[58] Field of Search ..... 242/423.1, 528, 242/541.3, 564.5, 595.1, 597.7

[56] References Cited

U.S. PATENT DOCUMENTS

| | | | |
|---|---|---|---|
| 2,928,618 | 3/1960 | Locke | 242/597.7 |
| 3,279,717 | 10/1966 | Schubert | 242/564.5 |
| 3,334,838 | 8/1967 | Kopp | 242/595.1 |
| 4,336,911 | 6/1982 | Fairchild | 242/423.1 |
| 4,901,935 | 2/1990 | Reist | 242/528 |
| 5,409,178 | 4/1995 | Stauber | 242/528 |

*Primary Examiner*—John M. Jillions
*Attorney, Agent, or Firm*—Walter C. Farley

[57] ABSTRACT

A method and device for unwinding from a roll (1) the scaled formation of printed products wound onto a winding core (11) with a winding tape (12). The braking of the rotation of the roll (1) necessary for maintaining the tension on the winding tape during unwinding, is produced by pressing one face of the roll (1) against an inclined supporting surface (1) by means of a component (N) of the roll weight, causing friction between the face of the roll and the supporting surface (10) which friction brakes the rotation of the roll.

17 Claims, 3 Drawing Sheets

$$R = \mu \cdot N = \mu \cdot P \cdot \sin\alpha$$

$$H = F - R = P\,(\cos\alpha - \mu \cdot \sin\alpha)$$

$$R = \mu \cdot N = \mu \cdot P \cdot \sin\alpha$$

$$H = F - R = P\,(\cos\alpha - \mu \cdot \sin\alpha)$$

METHOD AND DEVICE FOR WINDING PRINTED PRODUCTS IN SCALED FORMATION

FIELD OF THE INVENTION

The invention lies in the field of the further processing of printed products and concerns a method and device for unwinding printed products which are wound onto a winding core with the help of a winding tape, i.e. to re-establish a scaled stream of printed products from a roll of wound printed products. The method can also be reversed, i.e. it can be used for winding printed products in scaled formation around a winding core with the help of a winding tape.

BACKGROUND OF THE INVENTION

According to the state of the art, for intermediate storage or for delivery to further processing, printed products are e.g. fed into a so called winding station in form of a scaled stream and are wound onto a winding core with the help of a winding tape in this winding station. Also according to the state of the art, such rolls are unwound in unwinding stations very similar to the winding stations, i.e. the scaled formation is re-established. Winding and unwinding stations are e.g. described in the publications EP-447903 (or U.S. Pat. No. 5,158,242) and EP-447498 (or U.S. Pat. No. 5,176,333).

Winding and unwinding with known devices is e.g. carried out as follows:

For the winding process, an empty winding core with a winding tape, one end of which is e.g. fastened to the winding core and which is wound onto the winding core, is brought onto the drive shaft of the winding station and the winding tape is wound from the winding core onto an intermediate roll. Then the winding core is driven by the drive shaft and the scaled stream is fed between the tape and the winding core and is wound onto the winding core with the tape, whereby the winding tape is tensioned. After completion of the winding process the free end of the winding tape is fastened to the winding tape portion positioned underneath the free end and the roll is taken off the winding station.

Typical rolls produced according to the winding method described above have a weight of up to ca. 500 kg and a diameter of up to ca. 2 m. The length of winding tape required for winding is larger if the thickness of the scaled stream is small. Typical winding tapes have a length of up to 300 m, they are normally fastened with one end to the winding core and comprise locking means on the other free end, e.g. a Velcro fastener or a heat sensitive adhesive film. The rolls are only stable if the orientation of the products (position of folded edges etc.) in the roll, the distance between the scales and the tension of the tape are carefully matched.

For unwinding a roll, this roll is mounted on the drive shaft of an unwinding station. The end of the winding tape is disconnected, whereby the tension of the tape is maintained, and it is led to the intermediate roll. Then the tape and the scaled stream are unwound from the winding core, in such a way that the tension on the tape is still maintained. After completion of the unwinding the winding tape can be wound back onto the empty winding core.

An intermediate storage of printed products is necessary everywhere where products are produced at one time and are processed further at a later time. In addition to the distance in time between processing steps, there can also be a distance in locality, i.e. the printed products may be transported over long or short distances during the "intermediate storage".

An example of a process in which intermediately stored and/or transported printed products are further processed is the production of newspapers and magazines which besides components with a high topicality not only contain less topical components, i.e. components which can be produced earlier, but also less topical supplements. This kind of product is e.g. produced by assembling together the less topical components, i.e. components and supplements produced earlier, by means of collecting, inserting and or collating systems with the most topical component of each product which most topical component comes directly from a printing machine. The products to be put together can have the most diverse forms, i.e. they can be additional sections for newspapers, additional sheets for magazines, folded or stitched prospectuses, postcards, sample bags and a large variety of other items.

The tendency in this technology is not only to unite in one end product more and more product parts but also to create end products which are as individual as possible by combining different product parts. Regarding the apparatus side, this tendency leads to systems with more and more feeding points, i.e. to systems which require more and more space (become longer and longer) while at least part of the feeding points are not running to capacity.

The space which a feeding point requires on a processing system, e.g. on a collecting line or collecting drum, is only slightly larger than the width of the end product being produced. Feeding points which are handled in groups by one person are not really much wider. Feeding points which are equipped with sheet feeders are not much wider either as the sheet feeders can be arranged in a staggered formation. The sheet feeders are normally supplied with corresponding products by personnel, whereby little space is required for the personnel to pass through.

In contrast to the feeding points described above, the requirement for space becomes considerably larger if the feeding points are to be equipped with winding stations such that the products can be fed from rolls. As the rolls are normally transported to the winding station with a vehicle operating on the ground (stacker truck, movable cassette) even staggering the winding stations cannot create enough space. In other words feeding points equipped with winding stations require more space along a processing line than is needed by their mere function. If the rolls are brought in from above more space is required than with differently equipped feeding points because the roll must be brought onto the shaft of the winding station, i.e. space must be available which corresponds to at least the double width of the roll or product respectively. This means that existing buildings often do not allow addition of further feeding points with winding stations to processing lines or fitting differently equipped feeding points with winding stations.

Furthermore an unwinding station is a rather costly device the installation of which is only justified if it can be operated to run to capacity.

SUMMARY OF THE INVENTION

An object of the invention is to provide a method and to create a device with which the disadvantages named above caused by known winding stations and tight spatial conditions and/or varying rates of utilization, can be avoided. In other words this means that the inventive method and the inventive device are to make it possible to feed printed products from rolls into further processing such that the space taken up by the feeding device and the corresponding costs are a minimum. All the same a problem free and also discontinuous unwinding is to be possible.

As mentioned above the space requirement regarding space along a processing line for feeding from an unwinding station is substantially doubled by the fact that for unwinding the roll must be brought onto a shaft in especially for a shaft which is substantially parallel to the processing line. Therefore, it is the fundamental idea of the invention to carry out the unwinding process without a shaft. The braking function necessary for maintaining the tension on the winding tape during the unwinding and taken over by the shaft in the traditional unwinding process is, according to the invention, taken over substantially by a friction force generated between at least one of the faces of the roll and a corresponding surface of the unwinding device. During stand-still also, the friction prevents the tape from slackening by preventing rotation of the winding core which is not rotationally fixed by a shaft.

The friction between one face of the roll and a corresponding surface of the device can also be exploited in the opposite sense, i.e. for transmitting a rotation of a correspondingly driven surface of the device to the roll and thus not only for unwinding printed products from a roll but also for winding printed products onto a roll.

The inventive method comprises laying the roll to be unwound on an inclined supporting surface, whereby the supporting surface is designed such that the friction between the face of the roll and the supporting surface becomes sufficient for the braking function. At the same time the roll is supported in the direction of gravity by supporting means acting on the roll perimeter and substantially following the unwinding movement. This supporting means counteracts at least partly the component of the roll weight directed parallel to the slope of the inclined surface. The supporting means is substantially stationary such that during unwinding, the center of the roll slides on the supporting surface towards the supporting means, which sliding movement is also controlled by means of the friction between roll and supporting surface.

For achieving a problem-free unwinding process for different products the following parameters of the inventive method are variable: the angle of inclination of the supporting surface, the friction coefficient between roll and supporting surface (or between the roll or supporting surface and a corresponding intermediate element) and possibly the function of further parts of the device for counteracting at least partly the weight component directed parallel to the slope.

For augmenting the friction between the face of the roll and the supporting surface, in addition to the weight component directed perpendicular to the slope a further pressing force may be applied, e.g. a pressing force acting on the opposite face of the roll, by which further force the roll is pressed towards the supporting surface. This may be advantageous if the angle of inclination of the inclined supporting surface is large and thus the weight component generating the friction becomes small. The additional pressing force becomes especially important in the extreme case of an "inclined" supporting surface with an inclination angle of 90° in which the weight of the roll has no friction generating component.

BRIEF DESCRIPTION OF THE DRAWINGS

Embodiments of the inventive device are described in detail in connection with the following Figures, wherein.

DESCRIPTION OF PREFERRED EMBODIMENTS

Figure 1:
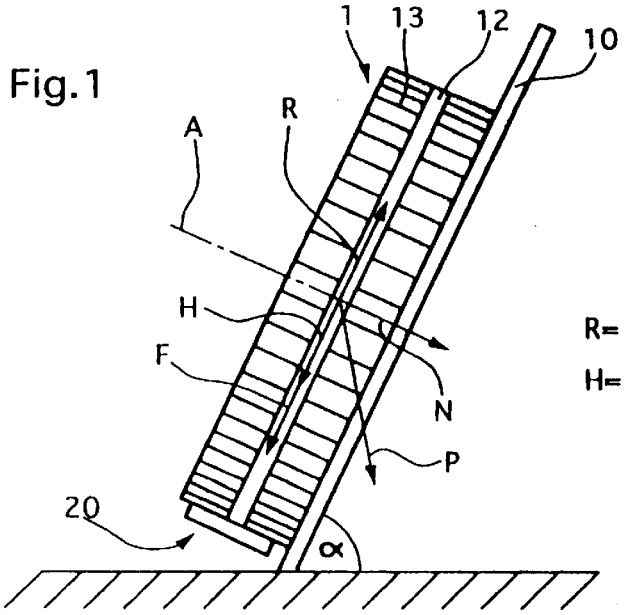
FIGS. 1 and 2 show the principle of the inventive method with the help of diagrammatic representations of an exemplified device at an angle of view substantially perpendicular to the axis of the roll (FIG. 1) and at an angle of view substantially parallel to the axis of the roll (FIG. 2)
Figure 2:
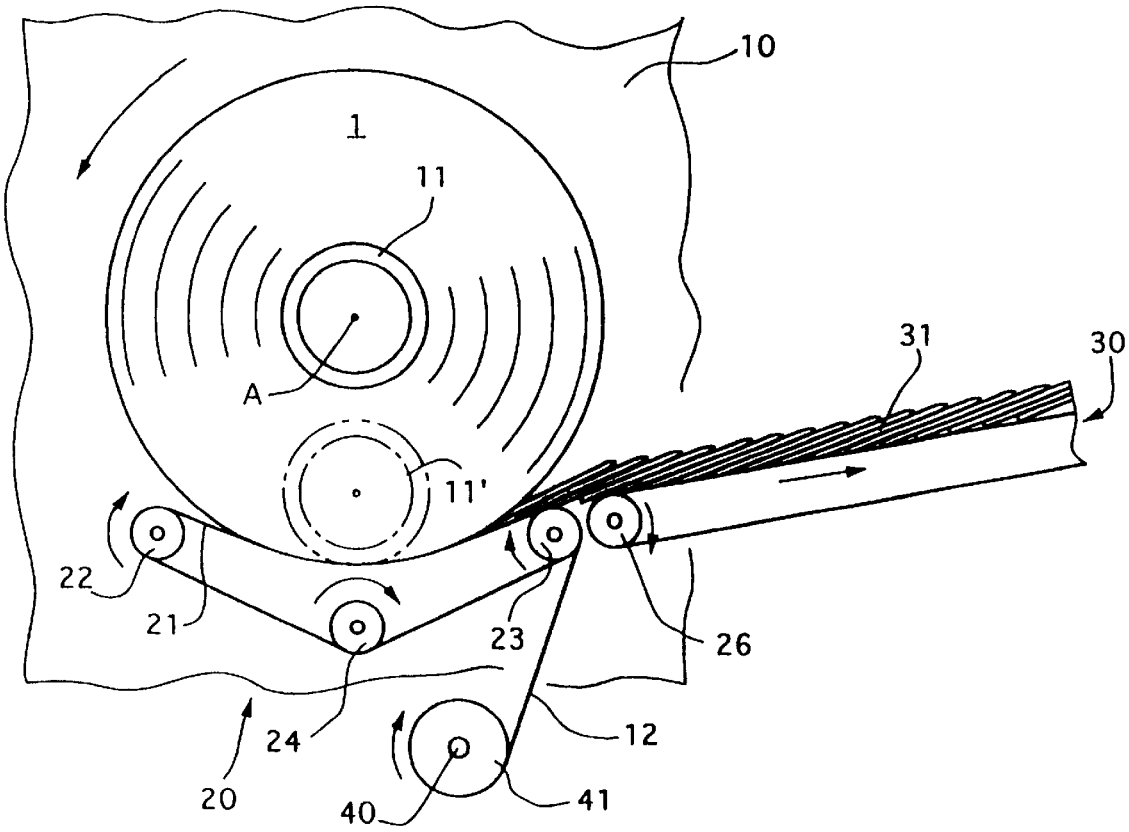

FIGS. 1 and 2 diagrammatically show the inventive device, in FIG. 1 viewed perpendicular to the axis of a roll positioned on a supporting surface and in FIG. 2 viewed in parallel to this axis.

FIG. 1 shows as substantial components of the device: an inclined supporting surface 10 which has an inclination angle $\alpha$ and supporting means 20, wherein the supporting surface 10 and the supporting means 20 are arranged such that together they can hold a roll 1 in a defined position. The roll 1 with an axis A consists of a winding core (not visible), a winding tape 12 and a scaled formation 13 of printed products wound onto the winding core with the help of the winding tape.

The supporting means 20 are e.g. substantially of the same width or wider than the wound products. As the roll is more dense in the area of the winding tape, the supporting means acts mainly on the winding tape. This is advantageous for sensitive products. For cases in which the supporting means 20 is to act more on the printed products, a pair of supporting means can be provided one on each side of the winding tape 12 (see e.g. FIG. 3).

FIG. 2 shows the same device as FIG. 1 at an angle of view substantially parallel to the axis A of the roll. Winding core 11 is shown in two positions: at the beginning of the unwinding process and, in broken lines (position 11') at the end of the unwinding process. The supporting means 20 is shown in more detail in this Figure. It e.g. consists of a supporting belt which runs over at least three guide rollers 22/23/24 and is longer than the shortest connection between the rollers. Therefore the belt 21 is pressed downward in an area between rollers 22 and 23 which area is loaded by the roll and is at least partly in contact with the perimeter of the roll. This action of the roll on the belt may be supported by correspondingly sprung guide means which act on the belt between rollers 22 and 23 in a sprung manner and in a downward direction pressing the belt 21 downward such that it sufficiently stabilizes laterally a roll which is only small and thus light or an empty winding core respectively and prevents it from being moved laterally by the unwinding movement.

Furthermore, the device comprises conveying means for removing the unwound scale formation e.g. a conveyor belt 30. The conveyor belt 30 runs over a guide roller 26 which is arranged in the area of the perimeter of the roll 1.

The device according to FIG. 2 also comprises means for rolling up the winding tape 12, e.g. a tape roller 41 driven by a drive shaft 40. Winding the winding tape 12 running from the roll over the guide roller 23, onto the tape roller 41 causes the roll to unwind and the printed products to be layed out onto the conveyer belt 30. Because the roll 1 rubs on the supporting surface 10 its rotating movement is braked and therefore the tension on the tape is maintained during the unwinding.

Unwinding of the roll happens as follows: the roll 1 is positioned on the inclined supporting surface 10 such that it is supported by the supporting means 20. The end of winding tape 12 is detached from the roll and by rotating the roll is pulled so far from the roll that it can be positioned over the guide roller 23 and be fastened on the tape roller 41. Then at least the tape roller 41 and the conveyor belt 30 are driven with the same perimeter speed thereby such winding the tape 12 onto the tape roller 41, rotating the roll 1 and unwinding the scaled stream 31, which is conveyed away by the conveyor belt.

The supporting belt 21 may also be driven during the unwinding process or it is designed such that it is driven by the movement of the products to be unwound or of the winding tape 12 respectively. In any case, by a corresponding movement of the supporting means 20, sliding of the products to be unwound on the supporting means is to be prevented as much as possible because it can cause the winding tape and/or the wound products to be retained upstream of the supporting area and therefore the roll to be de-stabilised and/or the products to be damaged.

Instead of the supporting means 20 in form of the supporting belt 21 shown in FIG. 2, other supporting means are possible e.g. two belts arranged in V-shape or a line of supporting rollers.

From FIG. 1 the relation of the forces acting in the inventive method is visible also. The roll has a weight P which can be divided into a normal component N perpendicular to supporting surface 10 and a parallel component F parallel to the supporting surface. The friction force R to be overcome equals $\mu N$ or $\mu \cdot P \cdot \sin\alpha$ wherein $\mu$ is the friction coefficient between the face of the roll and the supporting surface. This friction force brakes the rotation of the roll during unwinding thereby causing the tension of the winding tape to be maintained.

The force H parallel to the slope which corresponds to the difference between the parallel component F and the friction force R drives the roll downward on the supporting surface 10. The pressure of the roll on the supporting means during unwinding is higher or lower, depending on the friction coefficient and on the speed of the roll (reduction of the diameter of the roll). In standstill this pressure corresponds at the maximum to the parallel component F of the weight P of the roll.

As long as the inclination angle $\alpha$ is constant, all forces (N, F, H) relevant in the inventive method are in proportion to the weight P of the roll, i.e. they all decrease during the unwinding from a maximum value (corresponding to the weight of the full roll) to a minimum value (corresponding to the weight of the empty winding core).

The friction between the face of the roll and the supporting surface is set by a corresponding choice of the properties of the supporting surface ($\mu$) and by a corresponding choice of $\alpha$ such that the tension on the winding tape can be maintained even if the weight of the roll is small. The design of the supporting means 20 must be adapted to the parallel component F. The power of the shaft 40 must be adapted to the friction at maximal weight.

In order to prevent a dependence of the friction force on the roll weight it is possible to reduce the inclination angle $\alpha$ during the unwinding such that when decreasing the roll weight P, the normal force N and with it the friction is substantially stable or does not get smaller than a bottom limit.

Figure 3:
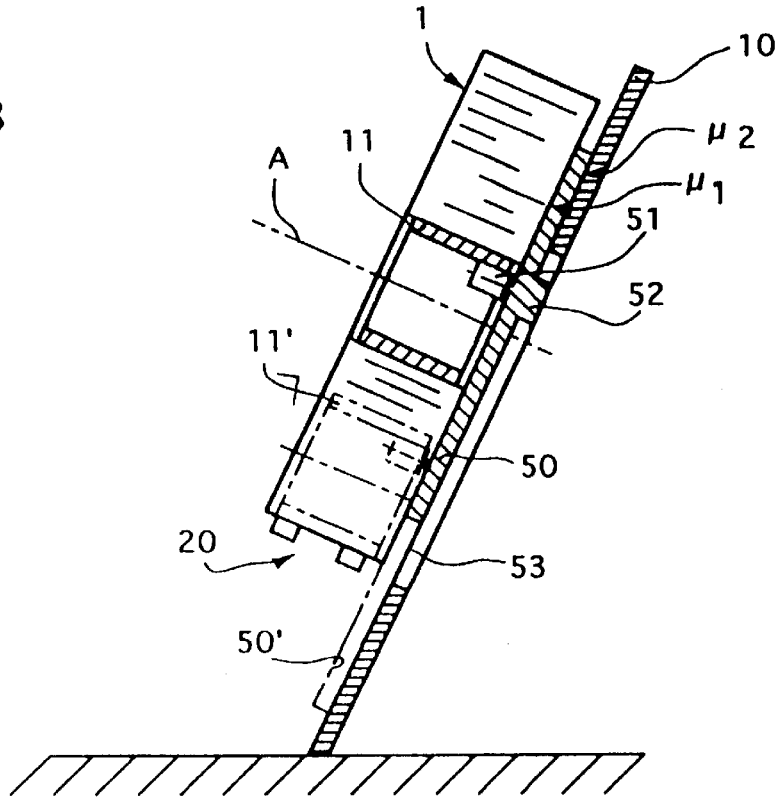
FIGS. 3 to 5 show further embodiments of the inventive device in section parallel to the axis of the roll and FIG. 6 shows a three-dimensional representation of a group of feeding points which are equipped with inventive devices.
Figure 4:
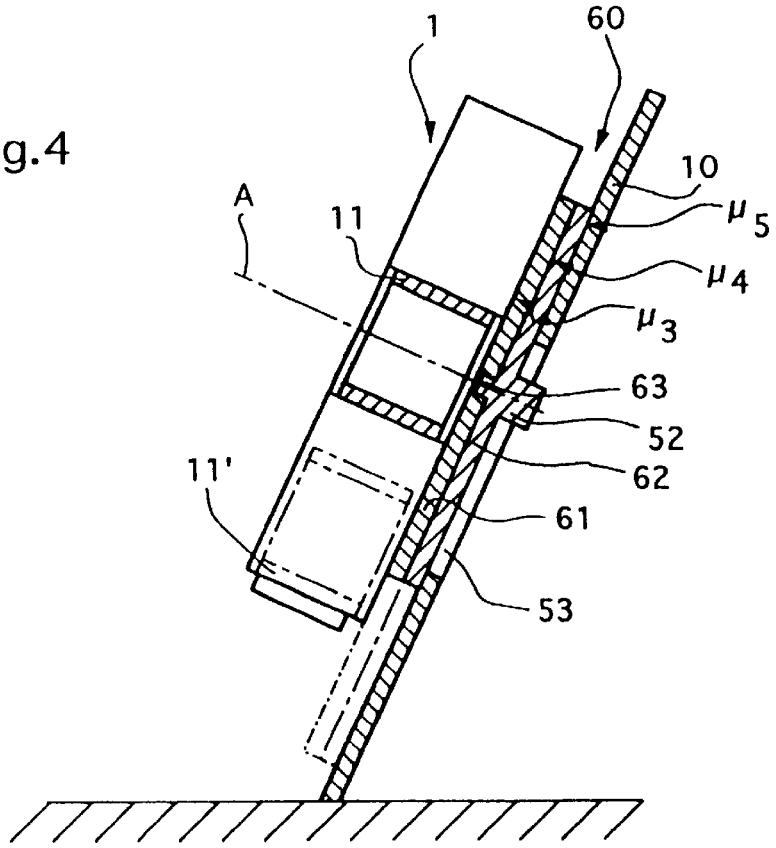
Figure 5:
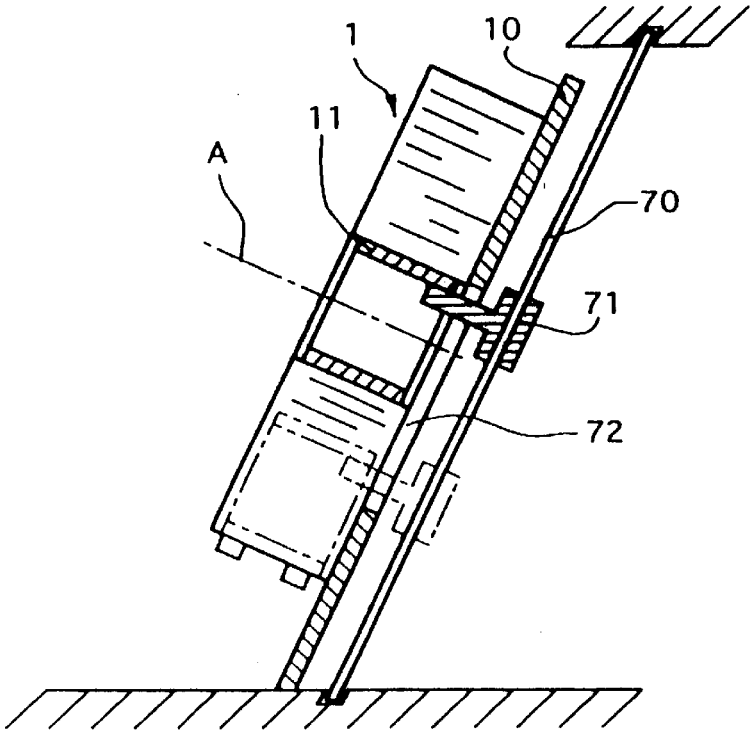

For embodiments with an effective space saving aspect, there is a lower limit to the angle $\alpha$. Due to impairment of the product edges positioned on the face of the roll by friction on the supporting surface there is an upper limit to $\mu$. As different friction forces may be desired for rotation of the roll and for its downward sliding movement it may be necessary or advantageous for specific applications to provide additional elements. FIGS. 3 to 5 show such additional elements. All these Figures are sections through the unwinding device with a roll 1 positioned on it and wherein the axis A of the roll lies in the section plane.

FIG. 3 shows an embodiment with an additional element in form of a face plate 50. This face plate 50 comprises a cog 51 reaching into the inner cavity of the winding core 11. The cog may be equipped with a freely rotating roller. Furthermore, the face plate 50 comprises a guide element 52 facing away from the roll 1 which guide element 52 is guided in a guiding slot 53 in the supporting surface 10 such that the face plate 50 can be moved up and down on the supporting surface 10 but cannot be rotated. The two surfaces of the face plate 50 and the supporting surface 10 are adapted to each other such that between the face of the roll and the one surface of the face plate 50 facing the roll a friction coefficient $\mu_1$ is generated and such that between the other surface of the face plate 50 and the supporting surface 10 a friction coefficient $\mu_2$ is generated, whereby $\mu_1$ generates an optimum braking force for the rotation of the roll and $\mu_2$ generates an optimum braking force for the sliding of the roll. It proves to be advantageous to choose $\mu_1$ to be smaller than $\mu_2$.

On unwinding, roll 1 rotates relative to the face plate 50 and is prevented from sliding downward relative to the face plate 50 by the cog 51. Roll 1 however slides downward together with the face plate 50 on the supporting surface 10, whereby a rotation of the face plate 50 relative to the supporting surface 10 is prevented due to the interaction of the guide element 52 and the guiding slot 53. 50' designates a lower position of the face plate 50.

If the face plate 50 is functionally coupled with a drive for a rotation it is not only possible to unwind rolls but it is possible with the same device also to wind a scaled formation onto a winding core or at least to rewind a just unwound part of the scaled formation back onto the winding core. In order to keep the pressure between the bottom side of the roll and the supporting means 20 in such a case at a tolerable value, it may be necessary to not only drive the rotation movement of the roll correspondingly but also the upwards sliding movement.

FIG. 4 shows a further additional element in form of a double face plate 60 positioned between the roll 1 and the supporting surface 10. This double face plate 60 consists of a rotation plate 61 facing the roll 1 and a sliding plate 62 facing the supporting surface 10, whereby the rotation plate is e.g. fitted rotatably on the sliding plate by means of cog 63. The double face plate 60 can e.g. be moved up and down on the supporting surface 10 by means of guide element 52 and guiding slot 53 but is secured against rotation. The surfaces of the rotation plate 61, the sliding plate 62 and the supporting surface 10 are designed such that the friction coefficient $\mu_3$ between the face of the roll and the rotation plate 61 is high causing the roll and the rotation plate to rotate together, such that friction coefficient $\mu_4$ between the rotation plate 61 and the sliding plate 62 produces a sufficient braking force for the rotation of the roll and that the friction coefficient $\mu_5$ between the sliding plate 62 and the supporting surface 10 produces a sufficient braking force for the downward sliding movement.

When unwinding a roll with the device according to FIG. 4, the rotation plate 61 rotates on the sliding plate 62 together with the roll 1, whereby the rotation plate is prevented from sliding downward relative to the sliding plate 62 by the cog 63. The roll 1, the rotation plate 61 and the sliding plate 62 slide downward together on the supporting surface 10, whereby a corresponding rotation is impeded by a corresponding design of guide element 52 and guiding slot 53.

A winding device according to FIG. 4 is advantageous for sensitive printed products, especially for products which, following unwinding, are not trimmed in the region of the edges forming the faces in the roll.

FIG. 5 shows a further variant of an unwinding device with an additional element which in this case consists of a spindle 70 and a axis element 71 movable up and down on spindle 70. The spindle 70 is arranged parallel to the supporting surface 10 and facing away from roll 1 and it is freely rotatable on bearings. Axis element 71 protrudes through a corresponding slot 72 in the supporting surface 10 and reaches slightly into the inner cavity of the winding core 11 of a roll 10 positioned on the supporting surface 10. The threads of spindle 70 and of axis element 71 are designed such that the arrangement is not self-locking and that the weight of the substantially empty winding core is still sufficient to rotate spindle 70 and to move the axis element 71 downward together with the roll 1 connected to it. Spindle 70 and axis element 71 do not only counteract a part of the force parallel to the slope but also stabilize the roll laterally which allows a more simple design of the supporting means 20.

As previously mentioned in connection with the device according to FIG. 3 the one part of the axis element 71 which protrudes into the winding core 11 may be equipped with a freely rotatable roller which rotates in the winding core during winding.

Spindle 70 and axis element 71 can also be designed as a self-locking system and spindle 70 connected to a drive means. The roll then moves downward at a speed corresponding to the spindle driving speed, whereby the whole force parallel to the slope is counteracted by the axis element 71 and the spindle 70. In such a case the supporting means 20 can be omitted. A driveable spindle 70 is also applicable for a device which is used for unwinding as well as for winding.

Figure 6:
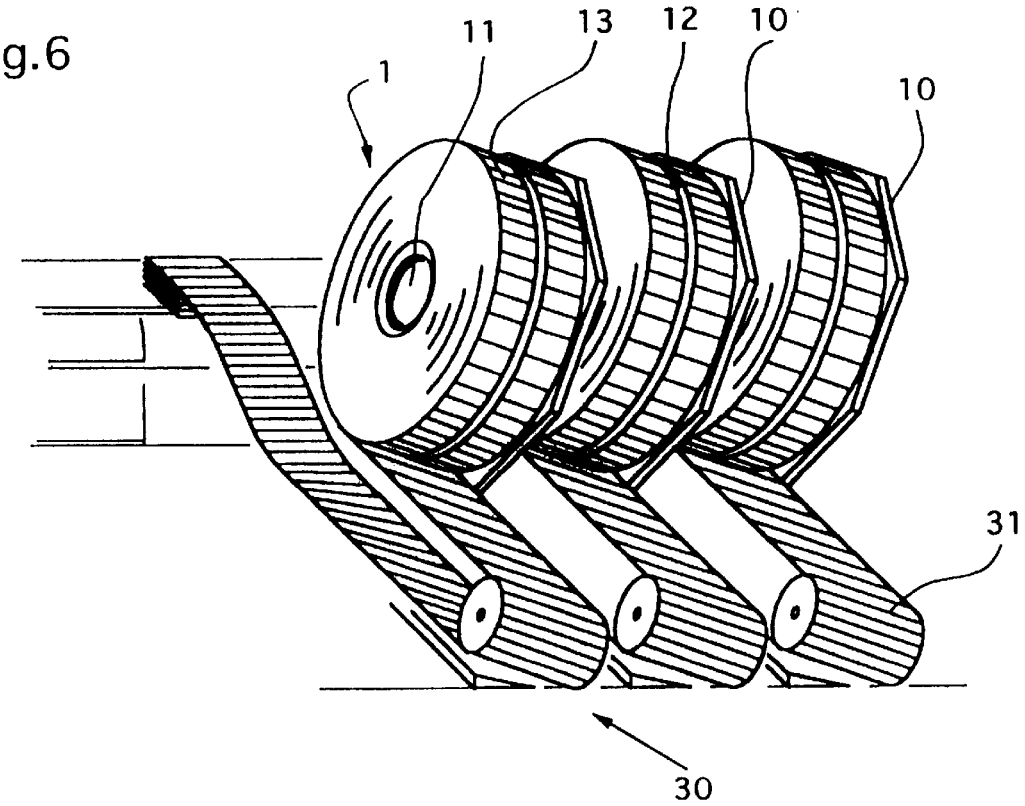

FIG. 6 shows as an illustration of the space saving achievable with the inventive method and with the inventive device, a group of unwinding devices with which feeding points of a processing line are equipped. The tape rollers are not shown. The unwinding devices are fitted with rolls from the side facing the viewer or from above.

The characteristics of the inventive method and the inventive device described in connection with the Figures can also be combined differently than shown.

A further variant of the inventive device consists in partly replacing one of two surfaces sliding on each other with friction, especially the one surface of the face plate or the supporting surface, which slide relative to the face of the roll, by a plurality of small braking rollers (axes of rollers parallel to radii of the roll) or by a star-shaped arrangement of braking cone rollers or by individual rollers or cone rollers. An embodiment with a star-shaped arrangement of cone rollers is especially suitable as a device for unwinding as well as for winding if the cone rollers are functionally coupled with a corresponding drive.

A further variant of the inventive method consists in holding the winding core in a stationary position during unwinding with the help of suitable holding means. In such a case it is be necessary to follow the decreasing diameter of the roll with the conveying means 30 for removing the unwound scale formation and with the supporting means 20. As such holding means counteract the total force parallel to the slope the supporting means 20 for such a case must be equipped correspondingly or may not be necessary at all.

I claim:

1. A method for unwinding a scale formation of printed products from a roll having the scale formation wound around a winding core with a winding tape, the roll having a roll axis, a peripheral surface and two axially spaced roll faces, the method comprising the steps of:

providing a supporting surface inclined relative to horizontal by an inclination angle of less than 90° and more than 0° and a support means for supporting a portion of the weight of the roll, positioning a roll to be unwound with one of the roll faces against the supporting surface with the support means holding the roll in a defined position, pulling the winding tape off of the roll to cause the roll to rotate about the roll axis in the defined position and to unwind the tape and the scale formation from the roll core, and maintaining sufficient frictional engagement between the one face of said roll and the supporting surface to create resistance to rotation, thereby keeping the tape under tension force within a predetermined force range as it is pulled from the roll.

2. A method according to claim 1 wherein the support means engages the peripheral surface of the roll.

3. A method according to claim 2 and including modifying the coefficient of friction of the inclined supporting surface to control frictional engagement between the roll and the surface.

4. A method according to claim 2 wherein frictional engagement is maintained by selecting the inclination angle of the supporting surface to produce a desired resistance as a function of a normal force component of the weight of the roll acting on the supporting surface and a coefficient of friction between the supporting surface and the roll face.

5. A method according to claim 4 wherein the support means is maintained in a substantially fixed position relative to the supporting surface and acts on a lowest part of the roll peripheral surface, whereby the roll face slides down the supporting surface and the roll axis lowers as the roll diameter is reduced with removal of the scale formation, the sliding between the roll face and the supporting surface being braked by frictional resistance between the roll face and supporting surface.

6. A method according to claim 5 wherein the friction for braking the roll rotation and friction for braking the downward roll sliding are kept within selected ranges by placing a face plate between the roll face and the supporting surface so that the roll rotates relative to the face plate and the face plate slides with the roll relative to the supporting surface whereby the coefficient of friction between the roll face and the face plate is adapted to the range of frictional force for braking rotation and the coefficient of friction between the face plate and the supporting surface is adapted to the range of frictional force for braking the sliding movement.

7. A method according to claim 5 wherein the friction for braking the roll rotation and friction for braking the downward roll sliding are kept within selected ranges by placing a two-part face plate between the roll face and the supporting surface, the two-part face plate including a rotating face plate rotatably carried by a sliding face plate so that the roll rotates with the rotating face plate and the roll slides with the sliding face plate relative to the supporting surface and wherein the coefficient of friction between the roll face and the rotating face plate is selected to prevent rotation of the roll relative to the rotating face plate and the coefficient of friction between the rotating face plate and the sliding face plate is adapted to the range of frictional force for braking the rotation, and the friction coefficient between the sliding face plate and the supporting surface is adapted to the range of frictional force for braking the sliding movement.

8. A method for winding a scale formation of printed products and a winding tape onto a winding core or onto a partial roll having a portion of a scale formation wound onto a core, the core having a roll axis, the core or the partial roll having a peripheral surface and two axially spaced faces, the method comprising the steps of:

providing a supporting surface inclined relative to horizontal by an inclination angle less than 90° and greater than 0° and a support means for supporting a portion of the weight of the roll, positioning a winding core or partial roll with one of the faces against the inclined supporting surface and with the support means holding the core or partial roll in a defined position, feeding a scale formation and a winding tape to the core or partial roll, and rotating the supporting surface to rotate the core or partial roll about the roll axis in the defined position and transmitting rotation to the core or partial roll by frictional engagement with the inclined supporting surface to wind the tape and the scale formation onto the core or partial roll.

9. A method for winding a scale formation of printed products and a winding tape onto a winding core or onto a partial roll having a portion of a scale formation wound onto a core, the core having a roll axis, the core or the partial roll having a peripheral surface and two axially spaced faces, the method comprising the steps of:

providing a supporting surface inclined relative to horizontal by an inclination angle less than 90° and greater than 0° and a support means engaging the core or peripheral surface, the supporting surface having a rotation plate generally parallel with the supporting surface and being rotatable relative to the supporting surface, positioning a winding core or partial roll with one of the faces against the rotating plate and with the support means holding the core or partial roll in a defined position, feeding a scale formation and a winding tape to the core or partial roll, and rotating the rotating plate to rotate the core or partial roll about the roll axis in the defined position and transmitting rotation to the core or partial roll by frictional engagement with the rotating plate to wind the tape and the scale formation onto the core or partial roll.

10. A device for unwinding a scale formation of printed products from a roll having the scale formation wound around a winding core with a winding tape, the roll having a roll axis, a peripheral surface and two axially spaced roll faces, the device comprising the combination of:

a supporting surface inclined relative to horizontal by a predetermined inclination angle less than 90° and greater than 0°;

a support means for holding a roll to be unwound in a defined position with one of said roll faces against the supporting surface; and means for pulling said winding tape from said roll at a predetermined speed, thereby causing said roll to rotate about said roll axis in said defined position and unwinding said tape and said scale formation from said roll core;

and wherein sufficient frictional engagement between the one face of said roll and said supporting surface creates resistance to rotation, thereby keeping said tape under tension within a predetermined force range as it is pulled from said roll without additional braking assistance.

11. A device according to claim 10 wherein said support means is at a fixed position relative to said supporting surface and acts against a lowest part of said peripheral surface.

12. A device according to claim 11 wherein said support means comprises an endless band or bands freely rotatable on a plurality of rollers.

13. A device according to claim 11 wherein said support means comprises an endless band or bands, and means for driving said band or bands at a speed substantially equal to the speed of said tape.

14. A device according to claim 11 wherein said support means includes means engaging and supporting said core.

15. A device according to claim 14 wherein said supporting means is movable up and down on said supporting surface.

16. A device for unwinding a scale formation of printed products from a roll having the scale formation wound around a winding core with a winding tape, the roll having a roll axis, a peripheral surface and two axially spaced roll faces, the device comprising the combination of:

a supporting surface inclined relative to horizontal by a predetermined inclination angle;

a face plate non-rotatably mounted adjacent said supporting surface and being movable vertically relative to said supporting surface;

a support means for holding a roll to be unwound in a defined position with one of said roll faces against said face plate; and means for pulling said winding tape from said roll at a predetermined speed, thereby causing said roll to rotate about said roll axis in said defined position and unwinding said tape and said scale formation from said roll core;

and wherein sufficient frictional engagement between the one face of said roll and said face plate creates resistance to rotation, thereby keeping said tape under tension within a predetermined force range as it is pulled from said roll without additional braking assistance.

17. A device for unwinding a scale formation of printed products from a roll having the scale formation wound around a winding core with a winding tape, the roll having a roll axis, a peripheral surface and two axially spaced roll faces, the device comprising the combination of:

a supporting surface inclined relative to horizontal by a predetermined inclination angle;

a sliding plate non-rotatably mounted adjacent said supporting surface and being movable vertically relative to said supporting surface;

a face plate rotatably mounted adjacent said sliding plate;

a support means for holding a roll to be unwound in a defined position with one of said roll faces against said face plate; and means for pulling said winding tape from said roll at a predetermined speed, thereby causing said roll to rotate about said roll axis in said defined position and unwinding said tape and said scale formation from said roll core;

and wherein sufficient frictional engagement between the one face of said roll and said face plate creates resistance to rotation, thereby keeping said tape under tension within a predetermined force range as it is pulled from said roll without additional braking assistance.

* * * * *